United States Patent [19]

Fecker et al.

[11] 4,361,292

[45] Nov. 30, 1982

[54] THREAD SUPPLY APPARATUS, PARTICULARLY FOR KNITTING MACHINE

[75] Inventors: Josef Fecker, Bisingen-Steinhofen; Gustav Memminger, Freudenstadt, both of Fed. Rep. of Germany

[73] Assignee: Memminger, GmbH, Freudenstadt, Fed. Rep. of Germany

[21] Appl. No.: 235,770

[22] Filed: Feb. 18, 1981

[30] Foreign Application Priority Data

Feb. 19, 1980 [DE] Fed. Rep. of Germany ..... 3006197

[51] Int. Cl.[3] ..... B65H 51/20

[52] U.S. Cl. ..... 242/47.01

[58] Field of Search ..... 242/47.01–47.13; 66/132 R; 139/452

[56] References Cited

U.S. PATENT DOCUMENTS

| | | | |
|---|---|---|---|
| 3,908,921 | 9/1975 | Jacobsson | 242/47.01 |
| 4,047,398 | 9/1977 | Fecker et al. | 242/47.01 X |
| 4,114,823 | 9/1978 | Fecker et al. | 242/47.01 |
| 4,138,866 | 2/1979 | Fecker et al. | 242/47.01 X |
| 4,153,213 | 5/1979 | Jacobsson | 242/47.01 |
| 4,247,057 | 1/1981 | Jacobsson | 242/47.01 |

*Primary Examiner*—Stanley N. Gilreath
*Attorney, Agent, or Firm*—Frishauf, Holtz, Goodman & Woodward

[57] ABSTRACT

To permit, selectively, use of multistrand monofilamentary thread or yarn, or twisted fiber thread or yarn with the same thread supply drum, the pull-off direction is changeably arranged by supporting a take-off thread guide eye (11, 11*a*) with respect to the axis of rotation (1') of the drum such that the orientation of the eye is either radial (FIG. 2: I; FIG. 3) or essentially tangential (FIG. 2: II, III; FIG. 4) or intermediate thereof; in the radial direction, individual strands which might be torn or broken are carried along by the running thread; in the tangential direction (FIG. 4), loose ends of fibers of fibrous yarn will not entangle other loops on the storage winding (22) of the drum. The take-off guide eye (11, 11*a*) either is secured to a pivotable U-shaped holding bracket 8 (FIG. 1) or can be slidable in a guide track 31 (FIGS. 5, 6). In the essentially tangential position, the take-off guide eye is preferably spaced by a somewhat greater distance from the rim (23) of the drum than in the radially aligned position.

21 Claims, 6 Drawing Figures

THREAD SUPPLY APPARATUS, PARTICULARLY FOR KNITTING MACHINE

The present invention relates to thread supply apparatus, and more particularly to thread or yarn supply apparatus for knitting machines, and especially for circular knitting machines.

BACKGROUND

Thread or yarn supply apparatus, also known as fournisseurs, usually include a rotatable storage drum to which thread or yarn is tangentially supplied, wound thereabout several times to form storage windings or storage loops thereon, and then again drawn off the drum by a take-off apparatus. Draw-off usually is over the edge of the bottom disk or rim of the drum and controlled by a draw-off eye, or the like, positioned at a predetermined distance below the lower edge of the drum. For some apparatus, the level of the draw-off eye can be adjusted with respect to the lower edge of the drum.

In one type of thread supply apparatus—see U.S. Pat. No. 4,138,866, to which German Patent Disclosure Document DE-OS No. 26 08 590 corresponds—the thread is drawn off by a draw-off element in form of a take-off eye located laterally adjacent the storage drum and by some distance below the lower edge thereof. Thread withdrawn from the storage windings on the storage drum is pulled off at an inclination downwardly and outwardly. Difficulties occur with such pull-off. Some yarns or threads to be handled have the tendency to tangle. Drawing off the thread outwardly at an inclination has been found to prevent entanglement of fiber portions or filament portions which project from the thread with other such fibers and filaments and which might cause some loops of the storage windings to be pulled off together with the thread or yarn to be drawn off. Such unintentional pull-down of additional loops of the storage winding might lead to operating interruptions and misfeeds. The danger of pull-down of additional loops from the storage winding is particularly severe when fournisseurs operate with axial draw-off, in which the thread is drawn off approximately coaxially with respect to the axis of rotation of the storage drum by a thread guide eye located coaxially with the thread guide drum. The thread then is customarily held by a thread guide element located adjacent the edge of the run-out rim of the storage drum. Such a fournisseur is described, for example, in U.S. Pat. No. 3,908,921, Jacobsson, to which German Disclosure Document DE-OS No. 2 312 267 corresponds. Problems due to loops being pulled down together with the thread which is being supplied have led to almost complete discontinuance of this type of structure.

Fournisseurs must handle many types of threads and yarns. When handling multifilament yarns made of several strands of monofilamentary yarn, particularly of such thread or yarn of low quality, it is practically unavoidable that individual strands become damaged or torn, for example due to different treatment in advance of the yarn being supplied to a knitting machine. Spinning, stretching, texturizing, spooling and respooling may all cause damage to strands of the yarn. Currently used yarn in which such individual strands are hardly twisted together, but rather are placed more in form of a bundle of essentially parallel filaments are particularly subject to the danger of damage and to severing of individual filaments within the bundle.

It has been found that thread supply apparatus in which a take-off thread guide element is located laterally beneath the edge of the storage drum causes difficulty when handling multistrand threads. The thread is drawn off laterally, at an inclination, and downwardly from the storage drum. The damage which can be caused apparently is due to catching of individual strands on the storage drum or on the storage winding on the drum and being again wound on the drum. Consequently, an accumulation of filaments may occur in the region of the path of the thread or yarn from the storage drum, which leads to interference with smooth pull-off of the thread and, eventually, to thread breakage. Fournisseurs of this type are eminently suitable to handle twisted fibers; when used, however, with multistrand single-filament yarns, it is necessary to engage in additional measures in order to prevent interference of operation of the textile machine, typically a circular knitting machine, by strands or individual filaments which tear.

THE INVENTION

It is an object to provide a fournisseur which is capable of handling any type of yarns or threads, not only twisted fibers but, selectively, also multistrand monofilamentary threads or yarns without damage and danger of malfunction in operation.

Briefly, a thread support means is provided to support the thread take-off guide means in a plane extending at right angles to the axis of rotation of the drum. The thread support means is adjustable in at least two different positions of orientation with respect to the axis of rotation. In one position of orientation, for example, it is directed radially with respect to the circumference of the draw-off edge of the drum; in another direction of orientation, it is directed tangentially; intermediate positions, in which the direction of orientation forms a secant can be provided, the specific directions preferably being determined by releasable interengaging locks, such as a spring pressed ball fitting into a depression.

The respective different directions or positions of orientation provide for different angles of thread pull-off as it passes over the pull-off ring or rim of the thread storage drum upon being drawn off and guided by a guide take-off eye, or the like. Additionally, the take-off guide element is adjustable with respect to the distance with respect to the edge of the rim.

By adjusting the position of the thread guide element with respect to the rim of the drum from one position to another, various types of threads can be handled by the same fournisseur, without danger that individual loops are drawn off the storage winding by tangling of yarn. In another position, the fournisseur is suitable for handling multistrand monofilamentary yarns, even those of low quality and in which individual yarns may be damaged or torn. Change-over can be accomplished easily by simple readjustment of the position of the thread guide element as desired and in accordance with the types of yarns being handled, without necessity to tear the thread being wound, and hence rethread the machine, which is time-consuming. It is thus possible to merely knot a new yarn to an old one, and the machine will then be threaded with the new yarn and ready for operation upon readjustment of the yarn guide element in accordance with the characteristic of the yarn then to be handled.

DRAWINGS

Figure 1:
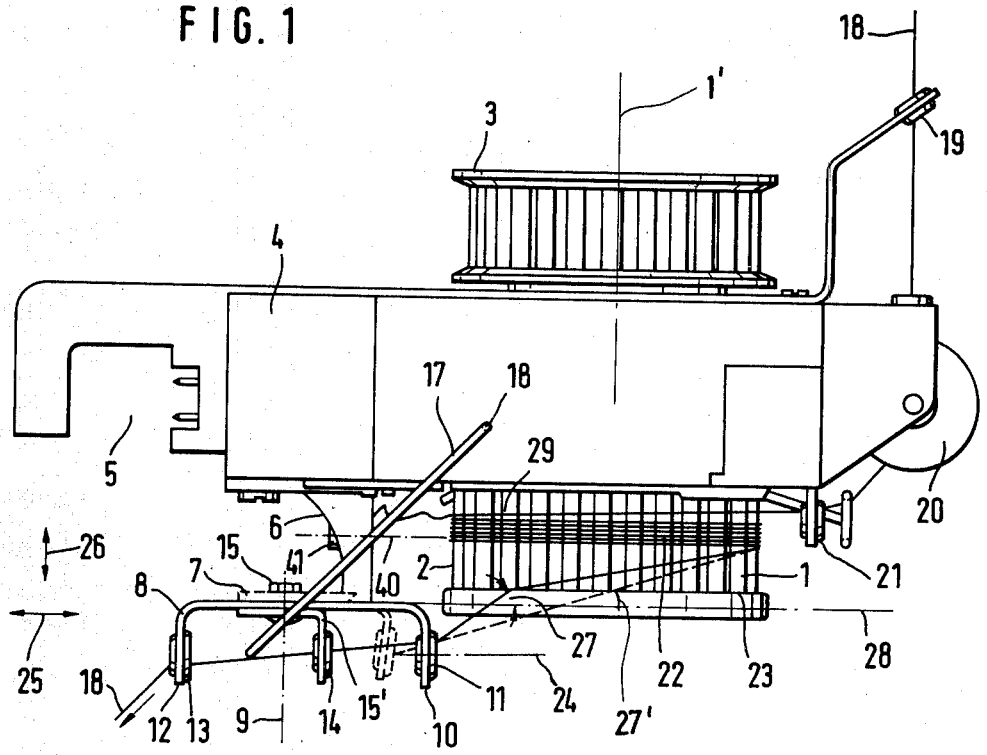
FIG. 1 is a highly schematic side view of the fournisseur.

A thread storage drum 1, constituted, for example, of a plurality of rods 2 secured between two end disks, is rotatable about an axis of rotation 1'. The rods 2, together, define essentially a cylinder. The drum 1 is driven in accordance with any well known manner, for example by a drive shaft coupled to a coaxial drive belt pulley 3, which can be coupled, for example, to a drive belt which is driven by the main drive of a circular knitting machine with which the fournisseur is used. A holder 4 is formed with an attachment hook 5 with which the fournisseur can be clamped to a fournisseur holder ring (not shown), a customary part of a knitting machine. A guide holder element 6 is located on the holder 4 at the bottom side thereof laterally adjacent the drum 1. An angle bracket 7 is secured to the holder 6, for example by means of an adjustment screw 41 which engages an oval hole in the upper angle portion (with respect to FIG. 1) of the bracket 7 to permit vertical adjustment of the bracket 7. An essentially horizontal U-shaped bracket 8 is secured to the bracket 7. Bracket 8 is rotatable with respect to bracket 7 over a vertical axis 9. One of the legs of the U-shaped bracket 8, namely leg 10, carries a thread guide element 11 in the form of a thread eye. A further thread support element 14 is secured by an angle bracket 15' on the bracket 8. The support element 14 additionally supports the thread, and cooperates with the take-off thread guide element 11 and the run-out eye 13.

Figure 2:
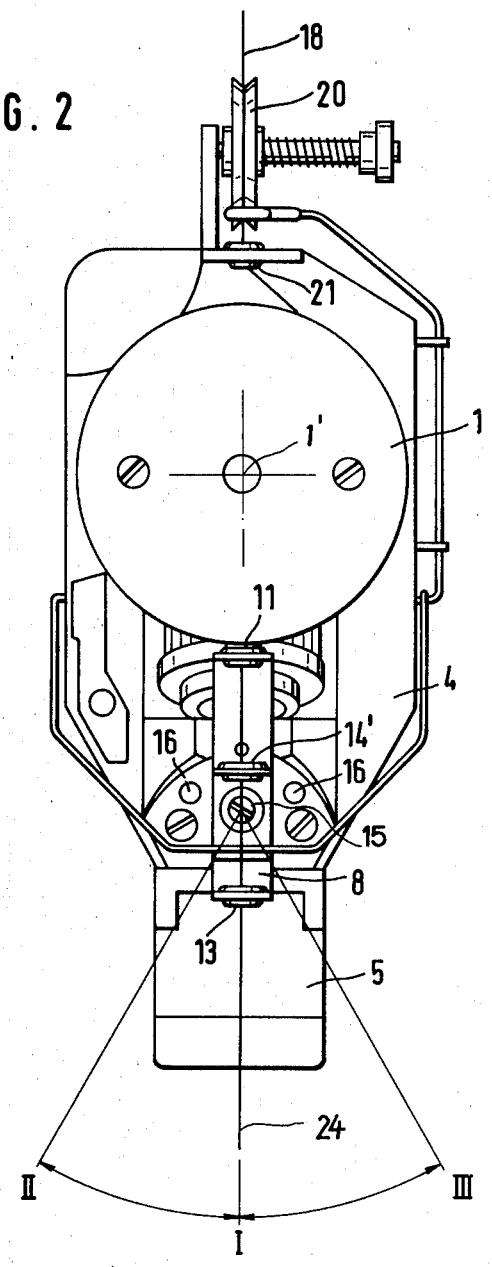
FIG. 2 is a bottom view of the fournisseur.

The bracket 8 is connected to the bracket 7 by screw 15 so that bracket 8 is rotatable over a limited degree about the axis 9. The position of the bracket 8 with respect to the bracket 7, that is, the orientation of the U-shaped bracket 8 with respect to the axis 1' of the drum 1, can be determined by suitable stops, preferably by use of spring-loaded balls which fit into suitably shaped depressions formed in the holder 6. Two such depressions are seen in FIG. 2 at 16. The depressions 16, together with the spring-loaded balls (not shown), permit predetermined positioning of the U-shaped bracket 8 in the respective position and ready change of position of the U-shaped bracket 8. Other arrangements to releasably secure the bracket 8 in predetermined position with respect to the axis of rotation 1' of the drum 1 may be used.

A thread stop-motion sensor 17, formed essentially as a U-shaped bail is provided; sensor 17 is rotatable about an axis 18. The sensor 17 is loaded by a spring or by gravity to be biassed in counter-clockwise direction—with respect to FIG. 1. It is positioned in the space between the thread support element 14, the run-out eye 13 and, as shown in FIG. 1, engages the thread 18, and senses tension and presence thereof as the thread is drawn off the drum.

The thread 18 is supplied from a supply package—not shown—and guided over an inlet guide element, for example eye 19, through a thread brake 20 to a supply guide element 21, for supply, for example, essentially tangentially to the drum 1. The thread is wound on drum 1 to form a plurality of storage loops or storage windings, to in turn form thread supply windings 22. The last loop from the thread supply windings 22 is drawn off over the bottom rim 23 through the take-off eye 11, the thread support element 14 and the run-out eye 13, for subsequent supply to a knitting position, for example, or other utilization device.

The thread support element 14 supports the thread 18 in the region between the take-off eye 11 and the run-out eye 13. This is particularly important if the thread 18 is to be supplied to the utilization device under particularly low tension. The stop-motion arm 17 need not be constructed as shown; it can also be arranged to form a compensating loop, for example when forming Jacquard-patterned goods, velvet, or the like, to provide for compensation of irregular thread use in knitting operations of this type, or in other knitting operations having non-uniform thread use during operation of the machine.

The stop-motion device 17 can be placed in various ways, for example as shown; it may also act on the thread 18 in the region between the take-off eye 11 and the support element 14. This is particularly suitable if, for example, the take-off eye 13 and the support element are formed as an elongated tube 14' (FIG. 2). To permit operation of the arm 17 in the position shown, and if the thread is guided through a tube, the tube can be slotted to permit engagement of the thread or yarn by the arm 17.

Figure 3:
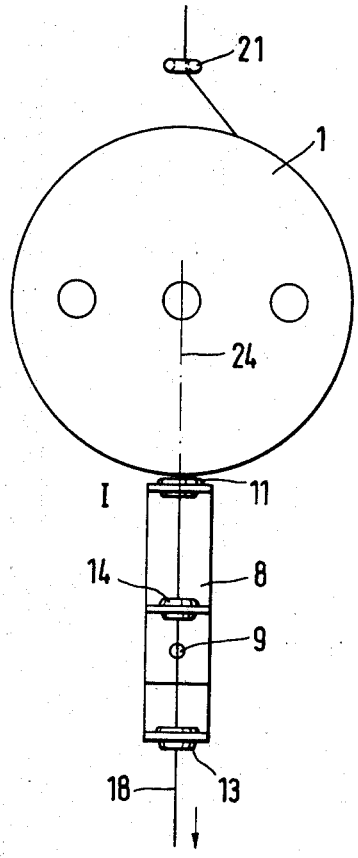
FIGS. 3 and 4 are, respectively, highly schematic bottom views omitting all unnecessary elements and showing two different positions of the thread guide element.

FIGS. 1, 2 and 3 show the U-shaped bracket 8 in a first position, in which the take-off guide eye 11 has its axis 24 (FIGS. 2, 3) positioned radially with respect to the storage drum 1. The take-off guide element formed by eye 11 is located slightly away from the rim 23 of the drum 1, and slightly below the plane of the rim 23. As best seen in FIG. 3, the thread guide eye 11 is so close to an imaginary cylinder surrounding the rim 23, and coaxial to the storage drum 1, that the thread guide eye 11 practically touches this cylinder. Basically, of course, the adjustment can be so made that the take-off thread guide eye 11 is below the bottom of the drum 1, and extends into such an imaginary cylinder.

Longitudinal positioning of the thread guide element 11 is done by positioning the U-shaped bracket 8 on the bracket 7 in longitudinal arrangement, as indicated by the arrows 25 (FIG. 1), for example by attaching the bracket through an elongated hole. The vertical position can be adjusted, as above referred to, by suitable positioning of the holder 6 in a vertical direction, or the bracket 7 with respect to the holder 6 in a vertical direction. The vertical adjustment position is schematically indicated by the double arrow 26 and, of course, can be constructed in any suitable and well known manner, e.g. again by oval or elongated slots.

The center position shown in FIG. 3 is suitable for handling of synthetic endless or monofilamentary threads which have only a low degree of twist or essentially none, and which, therefore, are particularly sensitive with respect to breakage of any one of the strands of the thread. The thread 18 is pulled off the rim 23 of the drum 1 at a comparatively steep angle with respect to a plane extending at right angle to the axis of rotation 1' of the drum, as shown at 28, FIG. 1. This angle 27 is comparatively large. Consequently, any loose strands 29 will, when reaching the bottom portion of the storage windings 22, be pulled along by the thread 18 which is drawn off at the angle 27, and carried along through the take-off guide 11 without the opportunity to wind on the drum 1, or without otherwise forming accumulations of strands or filaments in the path of the run-through of the thread which might lead to interruption of operation of the fournisseur.

The thread 18 is practically pulled down over the head of the drum 1 in this position of the thread guide eye 11. Consequently, this position is undesirable when using thread or yarn which is not monofilamentary but, rather, has a plurality of fibers. The ends of fibers projecting from the overall thread may cause some mutual engagement, that is, hooking together of adjacent loops of the storage windings 22. Consequently, the last loop of the thread 18, which is pulled off the drum, can carry along prior windings by engagement therewith; this would lead to collapse of thread tension and thus to stopping of the machine.

Figure 4:
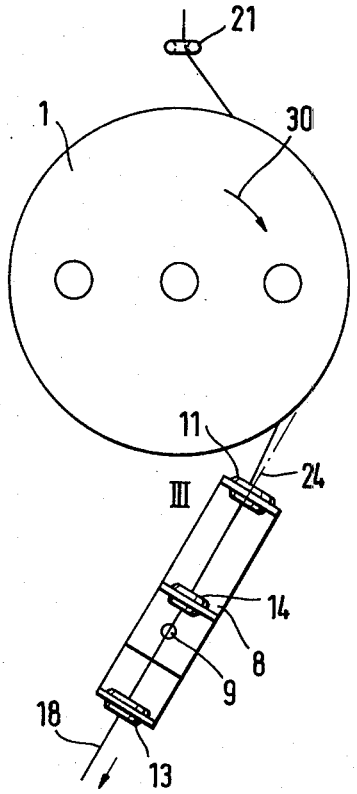

Upon change of yarn or thread type to be supplied, the U-shaped bracket 8 is switched in the plane 28 about the axis of rotation 9, for example into the position shown in FIG. 4. In this position, the axis 24 of the thread guide element 11 extends aat least approximately tangentially to the rim 23 of the drum 1. Of course, intermediate positions are possible in which the axis 24 of the eye 11 intersects a diametrical line of the drum 1, that is, forms a secant with respect to the cylinder or circle defined by the rim 23, or the drum 1, respectively. When the bracket 8 is set as in FIG. 4, for example, the interlocking engagement of, for example, a spring-loaded ball cooperating with the depression 16 (FIG. 2) holds the bracket 8 in the position shown. The thread guide element 11, when positioned as shown in FIG. 4 by engagement of the interlocking elements, has a greater lateral distance from the rim 23 than when it is in the position of FIG. 3—compare FIGS. 3 and 4. Consequently, the thread 18 as it is pulled over the rim 23 is traveling at an angle 27' with respect the plane 28 which is much less steep than the angle 27, as illustrated in broken lines in FIG. 1. This much shallower angle 27' prevents entanglement of sequential loops on the storage winding 22 and hence pull-down of winding loops from the drum.

FIG. 4 illustrates the position of the bracket 8 for use with twisted multifiber yarn or thread, for example, when the drum 1 operates in the direction in accordance with the arrow 30, that is, in clockwise direction as shown. The apparatus can readily accomodate reverse direction of drum rotation; it is only necessary to move the bracket 8 to a mirror image position with respect to that of FIG. 4, through the radial position of FIG. 3. FIG. 2 illustrates two fixed positions, I in the center for synthetic multistrand thread or yarn, and in the positions II and III for fiber thread or yarn with respectively reversed directions of rotation of the drum 1.

It is, of course, possible to provide for intermediate positions in addition to the positions I, II, III in which the bracket 8 can be releasably locked; continuous stepless adjustment between the adjustment range indicated by the positions II and III also can be used, for example by providing a clamping bracket or clamping screw, to clamp the bracket 8 in a predetermined angularly adjusted position with respect to the holding bracket 7.

Figure 5:
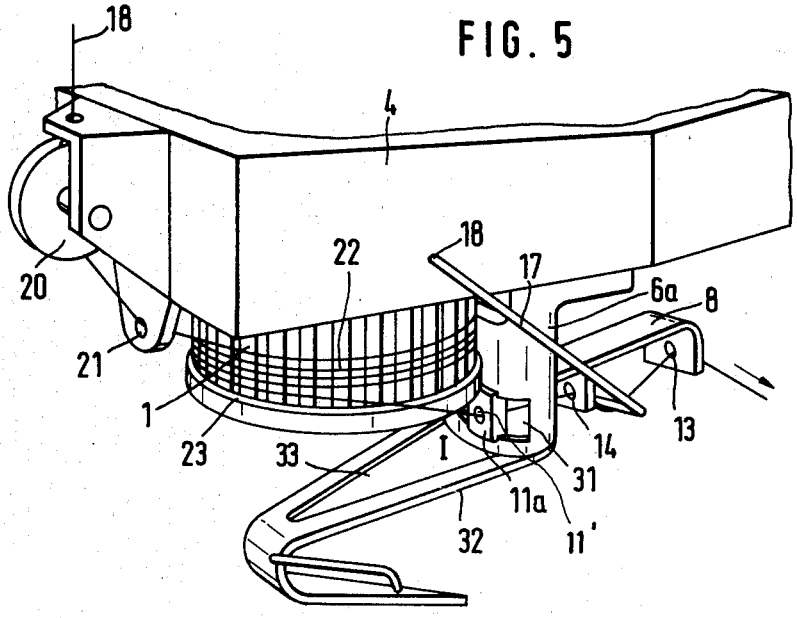
FIG. 5 is a perspective view of another embodiment of the invention.
Figure 6:
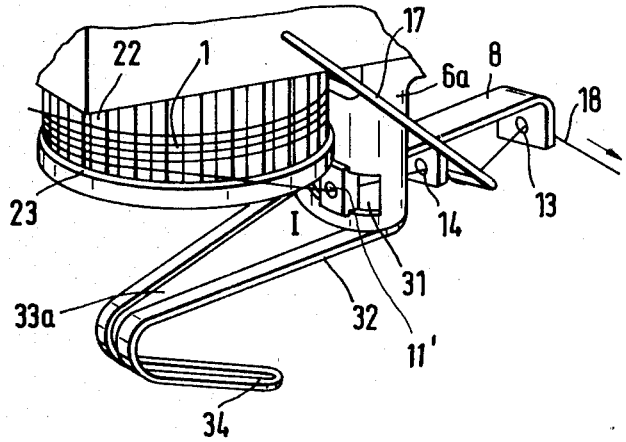
FIG. 6 is a fragmentary perspective view of yet another embodiment which is similar to that of FIG. 5.

Embodiment of FIGS. 5 and 6: The thread guide element 11*a* is shaped in form of a plate which is guided in a guide track 31 in a bracket 6*a* secured to the holder 4. Plate 31 is movable in the plane 28 between three positions, I, II, III, corresponding to the same positions in FIG. 2 only the position I is shown in FIGS. 5 and 6. The guide track 31 can be straight, that is, tangential with respect to the drum 1, curved as shown in FIG. 5, or reversely curved, that is, with a curved path which follows at least approximately the radius of curvature of the drum 1. The bracket 6*a* additionally has a thread guide bail 32 secured thereto which extends beneath the lower plane of the drum 1 and is formed with a slit-like opening 33 (FIG. 5) or 33*a* (FIG. 6) extending from the thread guide element 11*a* up to at least the axis of rotation of the drum 1. The opening 33, 33*a*, respectively, prevents formation of a reverse thread loop if thread tension should drop. Such a reverse loop, that is, a loop in reverse direction wound on the storage drum, results in malfunction. The slit-like opening 33 (FIG. 5) may extend up to about the axis of rotation of the drum 1; it may, however, extend further forward—see FIG. 6, where the opening 33*a* is so shaped that it extends up to about the end of the free leg 34 of the approximately U-shaped thread guide element 32. Of course, a similar unit or element 32 can be used also in the embodiment of FIGS. 1–4.

Various changes and modifications may be made. For example, the U-shaped bracket 8 (FIG. 1) and the angle bracket 7 can be secured on the holder 6 for rotation about a horizontal axis 40, FIG. 1. By tipping the unit 7, 8 from the central position shown in FIG. 2 into the plane of the figure, or out of the plane of the figure, the thread guide element 11 is laterally positioned with respect to the storage drum 1. The height of the thread guide element 11, that is, the distance from the bottom of the storage drum 1, or its rim 23 with respect to the axis of the drum, will also change; in addition to the tipping or slewing movement, it is also necessary to readjust the relative height of the element 11 with respect to the rim 23. A simple adjustment provides for passing the attachment screw 41—FIG. 1—through an elongated hole in the bracket 7, for example, so that the axial adjustment can be easily accomplished by loosening screw 41 and retightening in a selected position.

In a preferred form of the invention, the thread guide eye 11 is positioned slightly lateral distance from the rim 23 when axially aligned, and in essential tangential direction with respect to the drum 1 when aligned in accordance with positions II, III of FIG. 2 or FIG. 4. By placing the thread guide eye in the first position, that is, position I of FIG. 3, immediately adjacent the run-off rim 23 and at a predetermined distance therebelow, causes change of the thread guide position to a plane below the drum and in the region below its outer edge. Practical experience has shown that free single strands which have the tendency to wrap themselves about the drum are pulled off by this arrangement over the lower rim of the storage drum and are carried along by the remaining strands, that is, the entire thread, without causing difficulties.

When handling highly twisted yarn or threads, this arrangement is undesirable, however, since further loops from the storage can be pulled off with the very loop which is being drawn off. Thus, positioning the thread guide element 11 in the position II or III, respectively, in dependence on the direction of rotation of the drum, insures that the pull-off direction becomes less steep, so that what might be termed generally tangential pull-off in a downwardly inclined direction results. Multiple removal of loops from the storage windings is then avoided.

The various thread guide elements, described as eyes, may also be formed similar to eyelets or guide hooks. Preferably, they are formed as eyes with a slit 11' at a side to facilitate threading of the yarn or thread through the eyes (see FIGS. 5 and 6).

The simplest structural arrangement is obtained when mounting the thread guide elements on the U-shaped bracket 8 which is pivotable about pivot axis 9 which is parallel to the axis of rotation 1' of the drum 1. It is also possible, of course, to so mount the thread guide element 11 that it is guided in a guide track, as described in connection with FIGS. 5 and 6. The guide track can be suitably positioned with respect to the rim 23 so that it is somewhat below the rim. Use of the loop control element 32 shown in FIGS. 5 and 6 is particularly desirable in combination with the adjustably positionable take-off guide eye 11 since, upon decrease of tension of the yarn or thread being drawn off, a loop which might form will not wind itself on the storage drum in reverse direction.

The multiple guide eye structure formed by eyes 13, 14 in combination with the eye 11, as illustrated in FIG. 1, is particularly suitable for feeding yarn or thread under low tension. With this arrangement, a simple placement of the stop-motion sensing lever 17 is possible. The stop-motion arm 17 can have associated switch contacts adjustably positioned so that, rather than having the arm 17 sense the thread as shown in FIG. 1, it can be biassed by a spring or by weights to extend downwardly and provide a tensioned compensating loop when the utilization position requires yarn with non-uniform supply. The switch contacts would then be so arranged that the stop-motion device responds when a maximum swing of the arm 17 is exceeded. The thread guide element 11 and the thread support eyes 13, 14 are preferably located on a single common holding bracket 8. To-and-fro movement of the bracket 8 with respect to the axis 1' of the drum 1 is readily possible, for example by guiding screw or bolt 15 in an elongated slot. FIG. 1 illustrates in full line the position of the thread take-off eye 11 when the bracket 8 is in the radial position, that is, position I, FIG. 2; the broken-line position of the eye 11 and of the thread 18 corresponds to either of the positions II or III.

FIG. 2 additionally shows a thread guide and support element 14', extending from the inlet of the thread take-off guide means 11 to the run-out guide element 13. It may be in form a continuous elongated tube, for example made of glass or other abrasion-resistant material. A threading slot for the thread take-off guide **11*a* is shown in FIG. 5 at 11'**.

Features described in connection with any one of the embodiments may be used with any of the others, within the scope of the inventive concept.

We claim:

1. Thread supply apparatus for a textile machine, particularly for circular knitting machines, having a holder (4) including means (5) for attaching the holder to the textile machine;

a thread storage drum (1) rotatable about an axis of rotation (1') and having a pull-off rim (23) journalled in the holder;

thread supply guide means (19, 20, 21) to guide the thread onto the drum so that, upon rotation of the drum, a plurality of storage windings (22) will accumulate on the drum, secured to the holder;

thread take-off guide means (11, **11*a*) to guide thread being pulled off the storage winding over said pull-off rim (23), secured to the holder, and comprising, support means (6, 6*a*, 8, 10) supporting said thread take-off guide means (11, 11*a***);

and adjustable attachment means (15, 31, 41) securing said thread take-off guide means to the support means in a plane (28) extending at right angles to said axis of rotation of the drum and selectively adjustably locating the thread take-off guide means in positions:

(a) at least two different angular positions of orientation with respect to said axis of rotation (1') of the drum in which positions the angle of the thread as it passes over said rim (23) upon being drawn off the drum and guided by the take-off guide means, is respectively different with respect to said plane; and (b) with respect to the distance of the take-off guide means (11, **11*a*) from the rim (23**) of the drum.

2. Apparatus according to claim 1, wherein the adjustable attachment means secure the support means, when in a first position (I), to locate said thread take-off guide means (11, **11*a*) to have a take-off guide axis (24) extending radially with respect to the storage drum and spaced from said rim (23**) by only a slight clearance distance.

3. Apparatus according to claim 1, wherein the adjustable attachment means secure the support means when in a second position (II, III) to locate the thread take-off guide means to have a guide axis (24) extending essentially tangentially to said storage drum (1) and the rim (23) thereof.

4. Apparatus according to claim 2, wherein the adjustable attachment means further secure the support means when in a second position (II, III) to locate the thread guide means to have a guide axis (24) extending essentially tangentially to said storage drum (1) and the rim (23) thereof;

and wherein the spacing of said thread guide means when in said second position (II, III) from said rim is greater than the spacing thereof when in said first position (I).

5. Apparatus according to claim 1, wherein the adjustable attachment means secure the support means when in a second position (II, III) to locate the thread take-off guide means such that an axis (24) of said thread take-off guide means (11, **11*a*) forms a secant with respect to the circumference of the storage drum (1) or the rim (23**) thereof.

6. Apparatus according to claim 1, wherein the thread take-off guide means (11, **11*a*) are formed with a lateral slit (11'**).

7. Apparatus according to claim 4, further including positive positioning stop means (16) arresting said support means in at least three predetermined positions, in which one position (I) locates an axis (24) passing through said take-off thread guide means (11, **11*a*) radially with respect to the axis of rotation (1') of said drum, and in which two symmetrical off-radial positions (II, III) which locate the axis (24**) of the take-off thread guide means at an angle with respect to said radial position.

8. Apparatus according to claim 7, wherein said symmetrical positions are such that the axis (24) of the thread take-off guide means (11, **11*a***) extends at least approximately tangentially to the rim (23) of the drum (1).

9. Apparatus according to claim 1, wherein said support means comprises a U-shaped bracket (8) which is pivotable about a pivot axis (9) parallel to the axis of rotation (1') of the drum.

10. Apparatus according to claim 1, wherein said support means for said thread take-off guide means (11*a*) comprises a bracket (6*a*) formed with a fixed guide track (31) in which said thread take-off guide means is slidably positioned.

11. Apparatus according to claim 10, wherein said guide track (31) is curved.

12. Apparatus according to claim 1, further comprising a loop thread guide means (32) positioned beneath a plane (28) passing through said rim (23) and extending transversely to the axis of rotation (1') of said drum, said loop thread guide means (32) having a slotted opening (33, 33*a*) extending from a region of the thread take-off guide means (11, 11*a*) at least to the axis of rotation (1*a*) of said drum.

13. Apparatus according to claim 1, further comprising positive positioning stop means (16) selectively releasably arresting the position of said thread take-off guide means in a selected position of orientation with respect to the drum.

14. Apparatus according to claim 1, further including a thread support element (14) located behind—in the direction of thread movement—said thread take-off guide means to support said thread under low thread tension conditions.

15. Apparatus according to claim 14, further including a stop-motion device (17) engaging the thread and positioned between the thread take-off guide means (11) and said thread support means.

16. Apparatus according to claim 14, further including a thread run-off guide element (13) positioned behind—in the direction of movement of the thread—the thread support means;

and a stop-motion sensing element (17) positioned between the thread support means and the thread run-off guide element (13).

17. Apparatus according to claim 15, wherein said support means supports both said thread take-off guide means (11) and the thread support means.

18. Apparatus according to claim 16, wherein the support means supports said thread take-off guide means and additionally said thread support means and said thread run-off guide element.

19. Apparatus according to claim 1, including a holding element (6) secured in fixed position with respect to the axis of rotation of said drum;

wherein the attachment means attaches the support means to the holding element, and the support means (8) support the thread take-off guide means (11) and movably position said thread take-off guide means to-and-from with respect to the axis of rotation (1') of the storage drum, and hence of the rim in accordance with the selectively adjustment attachment by the attachment means.

20. Apparatus according to claim 1, further comprising a holder (6) secured in fixed position with respect to the axis of rotation of the drum;

and wherein the attachment means attaches the support means on said holder in adjusted rocked attachment about an axis (40) extending at right angles to the axis of rotation of said drum.

21. Apparatus according to claim 1, wherein said thread take-off guide means (11, 11*a*) is an elongated element providing for guidance of the thread at its inlet end and support of the thread for the distance of the length of the element in the direction of movement of the thread.

* * * * *